United States Patent [19]

Crawford

[11] Patent Number: 4,961,585

[45] Date of Patent: Oct. 9, 1990

[54] FLYING TARGET WITH MARKER

[76] Inventor: Joe T. Crawford, 411 W. Beachwood, Rose City, Mich. 48654

[21] Appl. No.: 385,819

[22] Filed: Jul. 27, 1989

[51] Int. Cl.[5] ..... F41J 9/16

[52] U.S. Cl. ..... 273/363; 273/365

[58] Field of Search ..... 273/363

[56] References Cited

U.S. PATENT DOCUMENTS 1,369,830 3/1921 Mitchell ..... 273/363

FOREIGN PATENT DOCUMENTS 2585820 3/1987 France ..... 273/363

*Primary Examiner*—Paul E. Shapiro

*Attorney, Agent, or Firm*—Michael L. Bauchan

[57] ABSTRACT

A flying target is provided which utilizes a conventional target disc made of a material which is readily broken when struck in flight by pellets, a marker assembly for marking the location where the target disc is broken and a retainer assembly for securing the marker assembly to the target disc until the target is broken by one or more pellets. The marker assembly includes a marker disc to which two ribbons are attached, each ribbon being provided with a weight and one of the ribbons having a second weight attached to it by a string. The folded ribbons are held between the target disc and marker disc, which is held to the target disc by the retainer assembly. The retainer assembly includes a film which covers the marker disc and is attached to the target disc.

14 Claims, 2 Drawing Sheets

FLYING TARGET WITH MARKER

BACKGROUND OF THE INVENTOR

This invention relates to flying targets and in particular those flying targets commonly used in trap or skeet shooting.

Flying targets of various types have been in common usage for many years. Some of them employ marker devices which are intended to fall to the ground approximately where the target is shattered by pellets. Examples are these are U.S. Patents Gerdes 1,966,342 and Feltus 2,653,026. Other examples are those in Italian Patents 330379 and 562863. Another example is in French Patent 890.001.

The various flying targets previously employed do not provide various advantages which have been accomplished by the subject invention.

It is an object of the present invention to provide a flying target with a marker assembly on the top of the target so as to minimize damage to the marker assembly when the target disc is shattered by pellets.

It is a further object of the invention to provide a target disc with marker assembly which is on top of the target disc and small in size to facilitate stacking target discs which each contain a marker assembly.

It is a further object of the invention to provide a target disc with marker assembly which is on top of the target disc and easily released from the target disc when only a small fraction of the target disc is shattered.

It is a further object of the subject invention to provide a target disc with marker assembly on to of the target disc and which provides for a large visual display of the shattered target and it's location.

It is a further object of this invention to provide a reusable marker assembly which is easily attached to the top of successive target discs.

It is a further object of this invention to provide a flying target with marker assembly which employs a conventional target disc and an external marker assembly such that when they are together they are similar to the target disc in size and weight so as to enable the flying target with marker disc assembly being ejected from a conventional catapult normally used to catapult a target disc without a marker assembly.

It is a further object of this invention to provide a marker assembly suitable for use with conventional target discs from multiple manufacturers and which apply to applicable standards of various sporting associations for use in competition.

It is a further object of this invention to provide a flying target with marker assembly which is particularly suitable for use in a game using a boundary fence toward which the flying target is propelled and shot from behind so that pellets strike the target on its top and side.

SUMMARY OF THE INVENTION

According to the present invention a conventional target disc is combined with a unique marker assembly which is secured to the top of a target disc by a unique retainer assembly. This has been accomplished by utilizing a concave marker disc containing a ribbon assembly that includes two weighted ribbons attached to the marker disc. The ribbons are folded and positioned in a concave lower surface of the marker disc, which is placed in a concave upper surface of the target disc so as to have minimal protrusion above the upper surface of the target disc. The marker assembly is secured to the target disc by a film retainer assembly having three equispaced extensions secured to the target disc. When part of the target disc is shattered by pellet impact so as to release at least one of the extensions of the film retainer, the marker assembly separates from the target disc. The weighted ribbons extend and steer the marker disc to the ground substantially at the location where the target disc was hit by pellets.

DESCRIPTION OF THE PREFERRED EMBODIMENT

Figure 1:
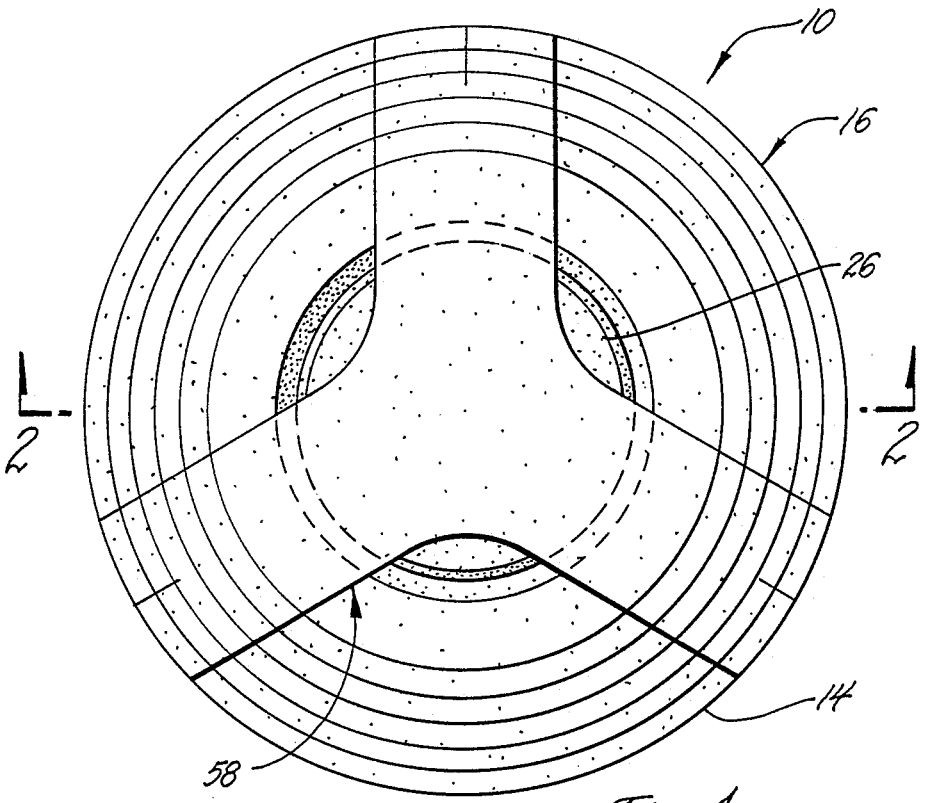
FIG. 1 is a top view of a flying target with a marker assembly and retainer assembly embodying the principals of the subject invention.

In FIG. 1 a flying target is generally shown by the number 10. It includes a target disc 12 of a conventional configuration. Target disc 12 is sometimes referred to as a "clay pigeon" and is of a conventional design made to be thrown by a conventional catapult and is made of a material such as clay which is readily broken when struck in flight by pellets fired by a shotgun as persons in the art will appreciate. A typical target disc 12 would be one known as the Remington Blue Rock, which is a trademark of Remington Arms Company, Inc., Ilion, N.Y. 13357.

Figure 2:
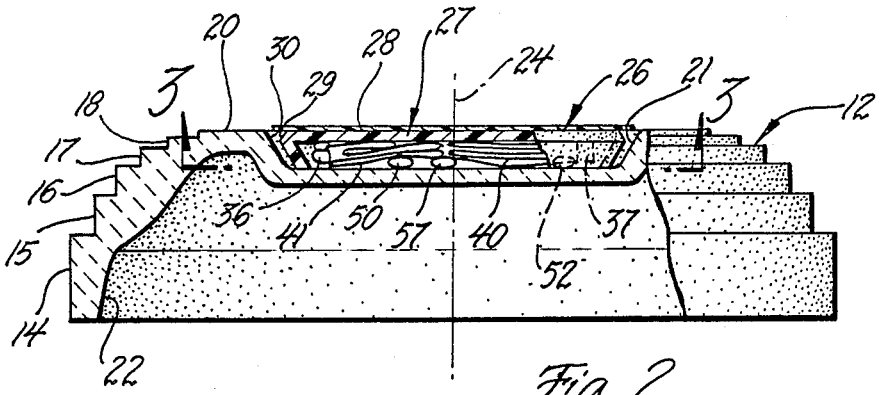
FIG. 2 is a section view of the target disc with marker assembly in FIG. 1 taken along line 2—2 but with the retainer assembly removed.

As shown in FIG. 2, the target disc usually has concentric rings 14–18 of decreasing diameter in it's exterior surface 20, which has a concave section 21 in the center of the top of target disc 12. The interior surface 22 is concave and facilitates the desirable flight characteristics and stacking of the target disc 12 on similar target discs for storage. The target disc 12 is made to be thrown by conventional catapults which have surfaces which cause the target disc 12 to be thrown edgewise with a spinning rotation about it's central axis 24.

The marker assembly 26 is designed to fit in the usual concave section 21 of the exterior surface 20 on target disc 12.

The marker assembly 26 includes a marker disc 27 made of a rigid plastic or rubber material having an outer diameter slightly smaller than the diameter of the concave section 21 in the exterior surface 20 of target disc 12. Marker disc 27 has an exterior surface which includes a top section 28 and a first tapered side surface 29 and a 45 degree angle from the flat top surface 28 is provided to streamline the marker disc 27 and avoid use of a sharp edge. A second side surface 30 at approximately a 71 degree angle to the plane of the top surface 28 is also provided to facilitate inserting the marker disc 27 in concave section 21 of target disc 12.

Figure 3:
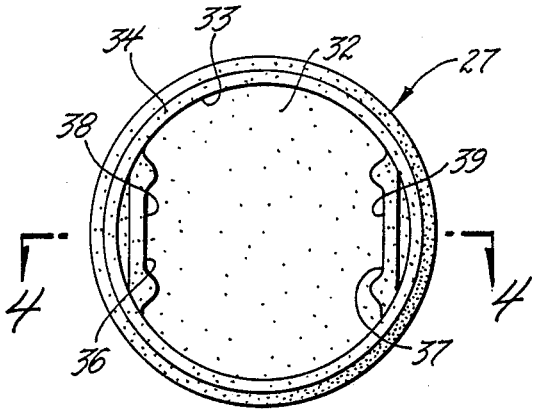
FIG. 3 is a bottom view of the marker disc employed in FIGS. 1 and 2.
Figure 4:
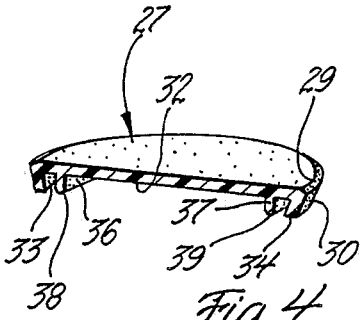
FIG. 4 is a plan view with parts removed of the marker disc in FIG. 3 taken along line 4—4.

The bottom surface of marker disc 27 as shown in FIG. 3 includes an interior surface 32 with a downwardly extending side wall 33 inside a circular bottom edge 34. Two hinges 36–37 are molded into the marker disc 27 so as to be rigidly secured to the inner surface 32 and the side wall 33 at each end. The hinges 36–37 have center sections 38–39, respectively, to facilitate attachment of ribbons. A partial cross-section plan view of the marker disc 27 in FIG. 3 is shown in FIG. 4.

Figure 5:
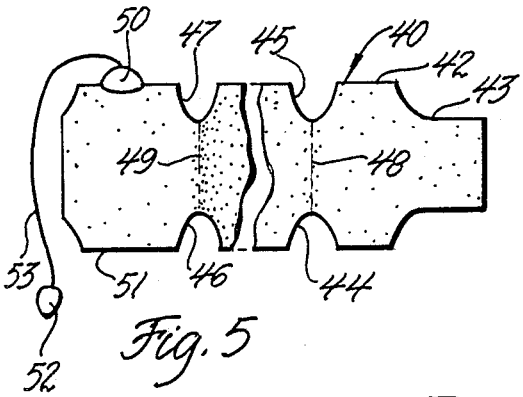
FIG. 5 is a plan view of a first ribbon assembly used in the marker assembly.
Figure 6:
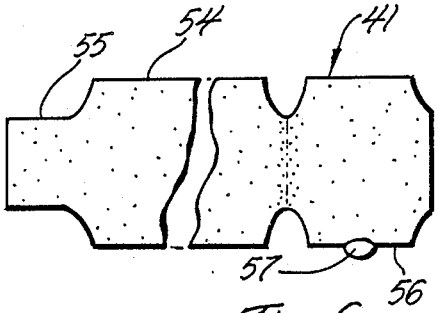
FIG. 6 is a plan view of a second ribbon assembly used in the marker assembly.

A first ribbon assembly 40 is shown in FIG. 5 and a second ribbon assembly 41 is shown in FIG. 6.

The first ribbon assembly 40 includes a plastic ribbon 42 which is elongated and in the preferred embodiment is approximately 18 inches long and approximately 0.005 inches thick. Ribbon 42 is tapered at one end 43 to width which facilitates insertion of end 43 under one of the center sections 38–39 of hinges 36–37. End 43 of ribbon 42 is then folded back upon itself and glued to the body of ribbon 42 so as to form a loop which encircles one of the center sections 38–39 so as to form a hinge connection.

In the preferred embodiment ribbon 42 has multiple notches equally spaced along it's length and on each side of ribbon 42. In the preferred embodiment notches 44–47 are at opposite ends of folds in ribbon 42, two of which folds 48 and 49 are shown. Folds 48–49 are provided to facilitate folding the ribbon 42 upon itself so as to form a compact size easily positioned between hinges 36–37. It should be noted each of the folds in ribbon 42 are positioned at right angles to the sides of the ribbon except for the last fold 49 at the end opposite the tapered end 43 for purposes which will become later apparent. The notches 44–47 are provided to reduce the length of the folds 48–49, thereby reducing the amount of ribbon 42 material which must be folded and unfolded which increases flexibility of folding ribbon 42 in cold weather.

A first weight 50 is attached to a second end 51 of ribbon 42. A second weight 52 is attached to one end of a string 53 and the other end of the string 53 is attached to the first weight 50. In the preferred embodiment the string 53 is a section of monofilament line of the type commonly used for fishing and the weights 50 and 52 are similar to lead weights commonly used for fishing of the "split shot" design which may be attached to the ribbon 42 and the string 53 by inserting them in the splits in weights 50 and 52 and then crimping the weights 50 and 52 to close the split and secure weights 50 and 52 to ribbon 42.

The fold 49 is at an angle as indicated so that as ribbon 42 is folded at fold 49 the weight 50 does not lie on part of ribbon 42 but rather lies adjacent ribbon 42. This is to minimize hot weather heating of weight 50 so as to cause it to fuse to the plastic comprising ribbon 42. The string 53 is sufficiently long so that when ribbon 42 is folded and positioned between hinges 36–37 the second weight 52 is adjacent one end of one of the hinges 36–37 on the side of ribbon 42 opposite weight 50.

The second ribbon assembly 41 shown in FIG. 6 is similar in design to the first ribbon assembly shown in FIG. 5 and it includes a ribbon 54 having a first end 55 which is tapered to fit under one of the hinges 36–37 and a second end 56 to which is attached the weight 57. The second ribbon 54 is thus similar to the first ribbon 42 in configuration except in the preferred embodiment it is approximately 10 inches long and employs a single weight 57.

As shown in FIG. 2, in the preferred embodiment the shorter ribbon assembly 41 when attached to hinge 36 is adjacent the inner surface 32 of marker disc 27 and the longer ribbon assembly 40 when attached to hinge 37 is folded to be between ribbon assembly 41 and the concave section 21 of target disc 12. In FIG. 2 all three weights, 50, 52 and 57 are shown to illustrate their relative positions with weights 50 and 57 in the center part of marker disc 27 while weight 52 is proximate hinge 37.

As is shown in FIG. 2, the entire marker assembly 26 is housed within marker disc 27.

Figure 7:
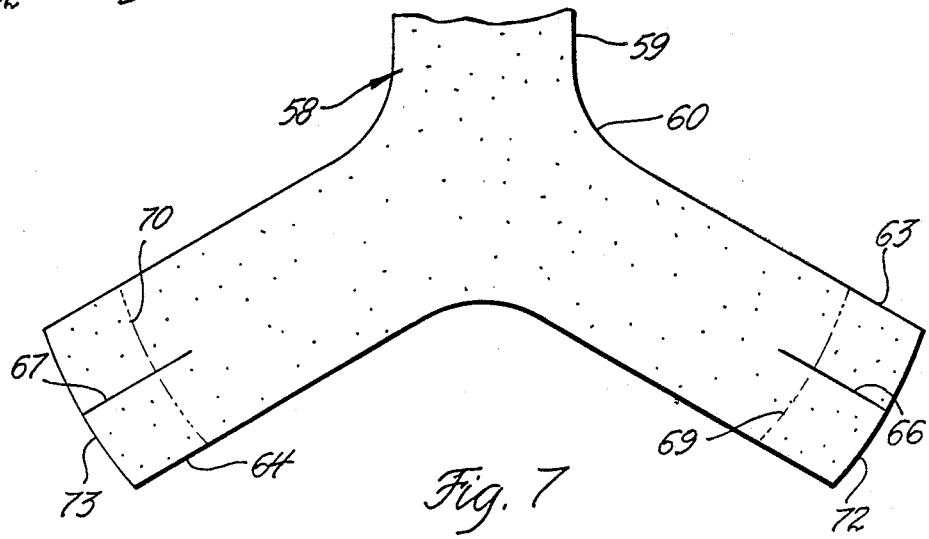
FIG. 7 is a plan view of the retainer assembly shown in FIG. 1.

In FIG. 7 a retainer assembly 58 is shown for retaining the marker assembly 26 in the concave section 21 in the top of exterior surface 20 of target disc 12.

Retainer assembly 58 includes a thin film 59 having a center section 60 which as shown in FIG. 1 substantially covers marker assembly 26. In the preferred embodiment the film 59 includes three equispaced extensions 62–64 extending radially outward. The extensions 62–64 are each split as shown at 65–67 and the ends extensions of 62–64 in the preferred embodiment are provided with an adhesive surface on the underside of film 59. The adhesive surface extends substantially from the dashed lines 68–70 to the ends 71–73 of extensions 62–64.

As shown in FIG. 1, the retainer assembly 58 substantially covers marker assembly 26 and each of the extensions 62–64 are long enough to be secured to the outermost ring 14 of target disc 12.

Persons versed in the art will appreciate that various modifications may be made to the subject invention without departing from the spirit of the invention.

In the preferred embodiment weight 57 is approximately 10 grains, weight 50 is approximately 15 grains and weight 52 is approximately 25 grains. The ribbons 42 and 54 may be made of polyethylene. It is preferred that the marker disc 27 and the ribbons 42 and 54 all be of a highly visible fluorescent orange color. It is preferred that the film 59 be clear so as to not affect the visible color of the target disc 12 as it is manufactured. Marker disc 27 may be made of neoprene or any suitable plastic. As the target disc 12 is thrown through the air it's spinning rotation will tend to cause weight 52 to abut one of the hinges 36–37. Therefore the length of string 53 is preferably about two inches and the ends of hinges 36–37 are rounded as shown to conform to weight 52 and retain weight 52 in position against a hinge 36–37 during flight.

In the preferred embodiment the ribbons 42 and 54 are approximately 1.125 inches wide except where they are notched to approximately 0.75 inches wide.

The marker disc 27 is approximately 2.0 inches in diameter and measures approximately 0.300 inches thick. The side wall 33 is approximately 1.687 inches in diameter and 0.180 inches deep.

As the target disc 12 with attached marker assembly 26 and retainer assembly 58 is thrown it is streamlined and flies with the same aerodynamics as the target disc 12 exhibits when thrown by itself. When one or more pellets strike the target disc 12, which protects the marker assembly 26, target disc 12 is broken by pellet impact. When one or more of extensions 62–64 of the film 59 is released from target disc 12, the marker assembly 26 slides out from between film 59 and target disc 12. Weight 52 falls away from ribbon 42 until string 53 is pulled taut, which jerks out second end 51 of ribbon 42, which then unfolds. When ribbon 42 unfolds the weight 57 also falls away from marker disc 27 so as to extend ribbon 54. Ribbons 42 and 54 then steer marker disc 27 in substantially a vertical fall to mark the approximate spot where target disc 12 was shattered by pellet impact and are easily seen to mark the spot, which is important in competitive shooting which requires accurate pellet impact location measuring.

It should be noted in particular that when the target disc 12 is used in a game in which target disc 12 is thrown toward a boundary fence and the object of the game is to shoot the target disc 12 before it crosses the boundary fence, the marker disc 27 protects the marker assembly 26 from damage by pellets. Marker disc 27 being made of neoprene or a suitable plastic is not made to shatter upon impact like the target disc 12 but rather is of a pellet resistant material. Thus when the target disc 12 is used in a game in which the target disc 12 is shot with pellets which generally strike it on the top and on the side the marker assembly 26 is quite protected, permitting use of the marker assembly 26 on numerous discs after each successive disc has been shattered by pellets.

It is thus apparent that a unique flying target with marker assembly is provided in which all of the above objects and many other advantages have been provided. Various modifications of the subject apparatus can be made without departing from the spirit of the invention.

I claim:

1. A flying target comprising, in combination, a target disc made of a material which is readily broken when struck in flight by pellets; a marker assembly for marking the location where said target disc is broken, said marker assembly including a marker disc and a ribbon assembly, said ribbon assembly including at least one ribbon having first and second ends, means for attaching said first ribbon end to said marker disc, at least one weight attached to said second ribbon end for extending said ribbon when said target disc is broken; and a retainer assembly for securing said marker assembly to said target disc until said target disc is broken by pellet impact and for releasing said marker assembly from said target disc when said target disc is broken by pellet impact so as to enable said weight to separate from said marker disc, and extend said ribbon so that said ribbon steers said marker disc in a substantially vertical fall to mark the location where said target disc was broken.

2. A flying target comprising, in combination, a target disc made of a material which is readily broken when struck in flight by pellets; a marker assembly for marking the location where said target disc is broken, said marker assembly including a marker disc and a ribbon assembly, said ribbon assembly including at least one ribbon having first and second ends, means for attaching said first ribbon end to said marker disc, at least one weight attached to said second ribbon end for extending said ribbon when said target disc is broken, and attachment means for attaching said weight to said second ribbon end, said attachment means including a string, said string having a first end attached to said weight and a second end attached to said second ribbon end whereby said weight separates the length of said string away from said ribbon second end before said weight pulls on said ribbon; and a retainer assembly for securing said marker assembly to said target disc until said target disc is broken by pellet impact and for releasing said marker assembly from said target disc when said target disc is broken by pellet impact so as to enable said weight to separate from said marker disc, thereby extending said ribbon so that said ribbon steers said marker disc in a substantially vertical fall to mark the location where said target disc was broken.

3. A flying target comprising, in combination, a target disc made of a material which is readily broken when struck in flight by pellets; a marker assembly for marking the location where said target disc is broken, said marker assembly including a marker disc and a ribbon assembly, said ribbon assembly including at least one ribbon having first and second ends, means for attaching said first ribbon end to said marker disc, at least one weight attached to said second ribbon end for extending said ribbon when said target disc is broken; and a retainer assembly for securing said marker assembly to said target disc until said target disc is broken by pellet impact and for releasing said marker assembly from said target disc when said target disc is broken by pellet impact so as to enable said weight to separate from said marker disc, thereby extending said ribbon so that said ribbon steers said marker disc in a substantially vertical fall to mark the location where said target disc was broken, said retainer assembly including a film substantially covering said marker assembly so as to secure said marker assembly between said film and said target disc and film attachment means for attaching said film to said target disc around the perimeter of said marker assembly at two or more points proximate said marker assembly so as to retain said marker assembly between said film and said target disc when all film attachment means are secured to said target disc and to permit said marker assembly to slide out from between said film and said target disc when one or more film attachment points are not secured to said target disc due to pellet impact.

4. The flying target of claim 3 in which said film comprises a central film body which substantially covers said marker assembly and at least two film extensions extending radially outwardly and downwardly for attachment to said target disc.

5. A flying target comprising, in combination, a target disc made of a material which is readily broken when struck in flight by pellets; a marker assembly for marking the location where said target disc is broken, said marker assembly including a marker disc and a ribbon assembly, said ribbon assembly including at least one ribbon having first and second ends, said ribbon having at least one fold, said ribbon having at least one notch proximate at least one fold, means for attaching said first ribbon end to said marker disc, at least one weight attached to said second ribbon end for extending said ribbon when said target disc is broken; and a retainer assembly for securing said marker assembly to said target disc until said target disc is broken by pellet impact and for releasing said marker assembly from said target disc when said target disc is broken by pellet impact so as to enable said weight to separate from said marker disc, thereby extending said ribbon so that said ribbon steers said marker disc in a substantially vertical fall to mark the location where said target disc was broken.

6. A flying target comprising, in combination, a target disc made of a material which is readily broken when struck in flight by pellets; a marker assembly for marking the location where said target disc is broken, said marker assembly including a marker disc and a ribbon assembly, said ribbon assembly including first and second ribbons, each ribbon having first and second ends, means for attaching said first ribbon first ends to said marker disc, at least one weight attached to said second ribbon ends for extending said ribbons when said target disc is broken; and a retainer assembly for securing said marker assembly to said target disc until said target disc is broken by pellet impact and for releasing said marker assembly from said target disc when said target disc is broken by pellet impact so as to enable said weights to separate from said marker disc and extend said ribbons so that said ribbons steer said marker disc in a substantially vertical fall to mark the location where said target disc was broken.

7. A flying target comprising, in combination, a target disc made of a material which is readily broken when struck in flight by pellets; a marker assembly for marking the location where said target disc is broken, said marker assembly including a marker disc and a ribbon assembly, said ribbon assembly including first and second ribbons, each ribbon having first and second ends, means for attaching said first ribbon ends to said marker disc, at least one weight attached to said second ribbon ends for extending said ribbons when said target disc is broken; and a retainer assembly for securing said marker assembly to said target disc until said target disc is broken by pellet impact and for releasing said marker assembly from said target disc when said target disc is broken by pellet impact so as to enable said weights to separate from said marker disc, and extend said ribbons so that said ribbons steer said marker disc in a substantially vertical fall to mark the location where said target disc was broken, said retainer assembly including a film substantially covering said marker assembly between said film and said target disc and film attachment means for attaching said film to said target disc at two or more points proximate said marker assembly so as to retain said marker assembly said film attachment means is between said film and said target disc when secured to said target disc at all of said points and to permit said marker assembly to slide out from between said film and said target disc when said film attachment means at one or more film attachment points is not secured to said target disc due to pellet impact.

8. The flying target of claim 7 in which said film comprises a central film body which substantially covers said marker assembly and three substantially equispaced film extensions extending radially outwardly and downwardly for attachment to said target disc around the perimeter of said marker assembly.

9. A flying target comprising, in combination, a target disc made of a material which is readily broken when struck in flight by pellets; a marker assembly for marking the location where said target disc is broken, said marker assembly including a marker disc and a ribbon assembly, said ribbon assembly including first and second ribbons each of said ribbons having first and second ends, means for attaching said first ribbon ends to said marker disc, first and second weights attached to said second ribbon ends for extending said ribbons when said target disc is broken, and attachment means for attaching said first weight weight to said first ribbon second end, said attachment means including a string, said string having a first end attached to said first weights and a second end attached to said first ribbon second end whereby said first weight may be thrown the length of said string away from said first ribbon second end before the mass of said first weight pulls on said ribbon; and a retainer assembly for securing said marker assembly to said target disc until said target disc is broken by pellet impact and for releasing said marker assembly from said target disc when said target disc is broken by pellet impact so as to enable said weights to separate from said marker disc, thereby extending said ribbons so that said ribbons steer said marker disc in a substantially vertical fall to mark the location where said target disc was broken, said retainer assembly including a film substantially covering said marker assembly so as to secure said marker assembly between said film and said target disc and film attachment means for attaching said film to said target disc at two or more spaced points proximate said marker assembly so as to retain said so as to retain said marker assembly between said film and said target disc when said film is attached a all of said points to said target disc and to permit said marker assembly to slide out from between said film and said target disc when one or more film attachment points are not secured to said target disc due to pellet impact.

10. A flying target comprising, in combination, a target disc made of a material which is readily broken when struck in flight by pellets and having a concave top surface; a marker assembly for marking the location where said target disc is broken, said marker assembly being positioned in said concave surface and including a marker disc and a ribbon assembly, said marker disc having a concave surface for receiving said ribbon assembly, said ribbon assembly being positioned in said marker disc concave surface and including first and second ribbons, each of said ribbons having first and second ends, means for attaching said first ribbon ends to said marker disc, first and second weights attached to said second ribbon ends for extending said ribbons when said target disc is broken, a third weight, a string having a first end attached to said first ribbon second end and a second end attached to said third weight whereby said third weight may be thrown the length of said string from said first ribbon second end before said third weight pulls on said first ribbon, each of said ribbons having at least one fold, each of said ribbons having at least one notch proximate at least one fold; and a retainer assembly for securing said marker assembly to said target disc until said target disc is broken by pellet impact and for releasing said marker assembly from said target disc when said target disc is broken by pellet impact so as to enable said weights to separate from said marker disc, thereby extending said ribbons so that said ribbons steer said marker disc in a substantially vertical fall to mark the location where said target disc was broken, said retainer assembly including a film substantially covering said marker assembly so as to secure said marker assembly between said film and said target disc, said film including a central film body which substantially covers said marker assembly and at least two film extensions extending radially outwardly and downwardly from said film body and film attachment means for attaching each of said film extensions to said target disc so as to retain said marker assembly between said film and said target disc when all of said film extensions are attached to said target disc and to enable said marker assembly to slide out from between said film and said target disc when one or more film extensions are not secured to said target disc due to pellet impact.

11. A flying target comprising, in combination, a target disc made of a material which is readily broken when struck in flight by pellets; a marker assembly for marking the location where said target disc is broken, said marker assembly including a marker disc and a ribbon assembly, said ribbon assembly including first and second ribbons each having first and second ends, means for attaching said first ribbon ends to said marker disc, at least one weight attached to said each of second ribbon ends for extending said ribbons when said target disc is broken, third weight, and attachment means for attaching said third weight to said first ribbon second end, said attachment means including a string, said string having a first end attached to said third weight and a second end attached to said first ribbon second end whereby said third weight may be thrown the length of said string away from said first ribbon second end before said third weight pulls on said first ribbon; and a retainer assembly for securing said marker assembly to said target disc until said target disc is broken by pellet impact and for releasing said marker assembly from said target disc when said target disc is broken by pellet impact so as to enable said weights to separate from said marker disc, and extend said ribbons so that said ribbons steer said marker disc in a substantially vertical fall to mark the location where said target disc was broken.

12. A flying target comprising, in combination, a target disc made of a material easily broken by pellet impact, a marker assembly for marking the location where said target disc is struck by pellet impact, and a retainer assembly for securing said marker assembly to said target disc until said target disc is struck by pellet impact and for releasing said marker assembly from said target disc when said target disc is struck by pellet impact so as to mark the location of said pellet impact, said target disc having upper and lower surfaces, said retainer assembly securing said marker assembly to said upper target disc surface, said retainer assembly including a film which substantially covers said marker assembly and is secured to said target disc at two or more points around the perimeter of said marker assembly whereby said marker assembly is retained between said target disc and said film until said target disc is at least partially broken by pellet impact and when said target disc is struck by pellet impact said film is separated from said target disc at least at one of said points, thereby permitting said marker assembly to separate from said target disc so as to mark the location of said pellet impact, said marker assembly including a marker disc and at least one ribbon which is folded and positioned between said marker disc and said target upper surface, said ribbon having one end secured to said marker disc so that when pellet impact breaks said target disc said ribbon unfolds and steers said marker disc to the ground so as to mark location of said pellet impact, said ribbon including two ends, one of said ribbon ends being secured to said marker disc, said marker disc assembly including at least one weight attached to the other end of said ribbon to facilitate unfolding said ribbon when said film is separated at one of said points upon said target disc being broken by pellet impact.

13. A flying target comprising, in combination, a target disc made of a material easily broken by pellet impact, a marker assembly for marking the location where said target disc is struck by pellet impact, and a retainer assembly for securing said marker assembly to said target disc until said target disc is struck by pellet impact and for releasing said marker assembly from said target disc when said target disc is struck by pellet impact so as to mark the location of said pellet impact, said target disc having upper and lower surfaces, said retainer assembly securing said marker assembly to said upper target disc surface, said retainer assembly including a film which substantially covers said marker assembly and is secured to said target disc at two or more points around the perimeter of said marker assembly whereby said marker assembly is retained between said target disc and said film until said target disc is at least partially broken by pellet impact and when said target disc is struck by pellet impact said film is separated from said target disc at least at one of said points, thereby permitting said marker assembly to separate from said target disc so as to mark the location of said pellet impact, said marker assembly including a marker disc and at least one ribbon which is folded and positioned between said marker disc and said target upper surface, said ribbon having one end secured to said marker disc so that when pellet impact breaks said target disc said ribbon unfolds and steers said marker disc to the ground so as to mark location of said pellet impact, said ribbon including two ends, one of said ribbon ends being secured to said marker disc, said marker disc assembly including at least one weight attached to the other end of said ribbon to facilitate unfolding said ribbon when said film is separated at one of said points upon said target disc being broken by pellet impact, said marker assembly including a string, said string connecting said weight to said ribbon so that when said target disc is hit by pellet impact said weight falls away from said marker disc until said string is taut and said weight then pulls on said ribbon so as to unfold said ribbon.

14. A flying target comprising, in combination, a target disc made of a material easily broken by pellet impact, a marker assembly for marking the location where said target disc is struck by pellet impact, and a retainer assembly for securing said marker assembly to said target disc until said target disc is struck by pellet impact and for releasing said marker assembly from said target disc when said target disc is struck by pellet impact so as to mark the location of said pellet impact, said target disc having upper and lower surfaces, said retainer assembly securing said marker assembly to said upper target disc surface, said retainer assembly including a film which substantially covers said marker assembly and is secured to said target disc at two or more points around the perimeter of said marker assembly whereby said marker assembly is retained between said target disc and said film until said target disc is at least partially broken by pellet impact and when said target disc is struck by pellet impact said film is separated from said target disc at least at one of said points, thereby permitting said marker assembly to separate from said target disc so as to mark the location of said pellet impact, said marker assembly including a marker disc and at least one ribbon which is folded and positioned between said marker disc and said target upper surface, said ribbon having one end secured to said marker disc so that when pellet impact breaks said target disc said ribbon unfolds and steers said marker disc to the ground so as to mark location of said pellet impact, said ribbon including two ends, one of said ribbon ends being secured to said marker disc, said marker disc assembly including at least one weight attached to the other end of said ribbon to facilitate unfolding said ribbon when said film is separated at one of said points upon said target disc being broken by pellet impact, said marker assembly including a string and two weights, one of said weights being attached to said ribbon other end and the other of said weights being connected by said string to said ribbon other end whereby said other weight separates from said ribbon until said string is taught and then pulls said other weight on said ribbon through said string so as to facilitate unfolding of said ribbon.

* * * * *

UNITED STATES PATENT AND TRADEMARK OFFICE

CERTIFICATE OF CORRECTION

PATENT NO. : 4,961,585

DATED : October 9, 1990

INVENTOR(S) : Joe T. Crawford

It is certified that error appears in the above-identified patent and that said Letters Patent is hereby corrected as shown below:

In Claim 11 in Column 8, Line 64, after "broken", insert:
---a third weight, and attachment means for attaching said third weight to said first ribbon second end, said attachment means including a string, said string having a first end attached to said third weight and a second end attached to said first ribbon second end whereby said third weight may be thrown the length of said string away from said first ribbon second end before said third weight pulls on said first ribbon---

In Claim 11, Column 9, Line 3, after "broken," delete the remainder of Line 3 and delete Lines 4 through 10, inclusive.

Signed and Sealed this

Twenty-sixth Day of January, 1993

*Attest:*

DOUGLAS B. COMER

*Attesting Officer*

*Acting Commissioner of Patents and Trademarks*